US010539384B1

(12) United States Patent
Persico

(10) Patent No.: US 10,539,384 B1
(45) Date of Patent: Jan. 21, 2020

(54) SPEED LOADER FOR A REVOLVER

(71) Applicant: Dennis P. Persico, Mahopac, NY (US)

(72) Inventor: Dennis P. Persico, Mahopac, NY (US)

(73) Assignee: Dennis Persico, Yorktown Heights, NY (US)

( * ) Notice: Subject to any disclaimer, the term of this patent is extended or adjusted under 35 U.S.C. 154(b) by 0 days.

(21) Appl. No.: 16/511,322

(22) Filed: Jul. 15, 2019

(51) Int. Cl.
*F41A 9/82* (2006.01)
*F41A 9/85* (2006.01)

(52) U.S. Cl.
CPC ..... *F41A 9/85* (2013.01)

(58) Field of Classification Search
CPC ..... F41A 9/82; F41A 9/83; F41A 9/84; F41A 9/85
See application file for complete search history.

(56) References Cited

U.S. PATENT DOCUMENTS 1,137,543 A * 4/1915 Sergeef ..... F41A 9/85 42/89
1,231,106 A * 6/1917 Wesson ..... F41A 9/85 42/89
1,891,437 A * 12/1932 Milmore ..... F41A 9/85 42/89
3,213,559 A 10/1965 Matich
3,252,238 A * 5/1966 Bye ..... F41A 9/85 42/89
3,785,077 A * 1/1974 Price ..... F41A 9/85 42/89
4,202,124 A 5/1980 Switzer
4,614,053 A * 9/1986 Billman ..... F41A 9/85 42/89
4,862,622 A * 9/1989 Goyanes ..... F41A 9/85 42/89
9,835,396 B1 * 12/2017 Sherman ..... F41A 9/85
10,209,018 B1 * 2/2019 Yaxley ..... F41A 9/85

OTHER PUBLICATIONS

Jagemann Sporting Group, "357 Mag," 2018, 3 pages.

* cited by examiner

*Primary Examiner* — Gabriel J. Klein
(74) *Attorney, Agent, or Firm* — Schmeiser, Olsen & Watts, LLP

(57) ABSTRACT

A speed loader for a revolver having a series of pivotally linked cartridge housings which are collapsible into a secured circular arrangement having an equivalent number of cartridge housings and matching the number of cylinders in a revolver. When in the collapsed position the speed loader allows for simultaneous re-loading of all cylinders with one hand. The cartridge housings are pivotally linked such that they are extendible into a straight line for safe and secure storage in a pocket.

6 Claims, 9 Drawing Sheets

Section A-A

Section C-C

SPEED LOADER FOR A REVOLVER

BACKGROUND OF THE INVENTION

1. Field of the Invention

The present invention relates to firearms, and more particularly to a speed-loading mechanism for securing, storing and releasing cartridges into a multiple chamber firearm such as a revolver, using one hand. More specifically, the invention relates to a link type cartridge speed-loading device having a plurality of cartridge housings pivotally secured to each other to secure a cartridge respectively therein where the mechanism is storable in a linear fashion with means to fold the mechanism into a circular configuration corresponding in radius to the center lines of the chambers in the revolver's cylinder for simultaneous insertion and release of the cartridges into their respective chambers in the rolled configuration.

2. State of Current Art

Hand-held firearms have widely been used by the law enforcement, the military and civilians for a long time. A continued favorite firearm for many people is the revolver. The revolver is universally accepted because of its simple mechanical design which makes for consistent reliability in the field. Properly maintained revolvers rarely jam or misfire hence their popularity for those with personal safety goals. Notwithstanding the many advantages revolvers, the main disadvantage is that revolvers contain a limited number of shots in one load. As a result, revolvers require frequent reloading, and the precious time spent on reloading significantly reduces the time the firearm can actually be used for firing at targets in a crisis situation. Revolvers are particularly prone to this type of deficiency since the cartridges have to be loaded into the revolver's chambers one cartridge at a time.

In general, there are two types of speed-loading devices available: strip loaders and solid cylindrical drum or cartridge type loaders. Each type has significant drawbacks.

Strip Loaders

A typical strip type cartridge speed-loading device consists of a series of links each of which is shaped and proportioned so as to secure a cartridge by clipping around a partial circumference at its base. These links are joined together to provide the proper number of cartridges for a specific firearm. One the advantages is that once secured in the loader, the cartridges may be stored or transported in a flat position making for easy, secure and confidential storage of one's reloadable cartridges.

One device is disclosed in U.S. Pat. No. 4,614,053 which includes individual links made of firm elastic materials that are sized and proportioned such that the cartridges of a specific caliber will snap or clip into or out of each link.

Another device disclosed in U.S. Pat. No. 9,835,396 includes disposable annular body formed by a plurality of integrally linked annular brackets adapted to receive and hold rimmed cartridges by clipping around a partial circumference of each cartridge.

A consistent drawback of these strip type loading devices is that during loading a large amount of force must be exerted to rotate adjacent links so as to spread the cartridge engaging portions away from the cartridge base to allow the cartridge to fall into the revolver's cylinder.

Many times an inadvertent lateral or radial force component tends to act upon the cartridge base as the links rotate about the offset axes which lateral component of force can cause the cartridge base to either sit incorrectly in or eject from its respective chamber in the revolver's cylinder, defeating the basic function of the loader.

Another disadvantage of the strip type loaders is the inability of the device to automatically assume and lock into a rolled configuration that would enable the cartridges projecting from the device to be easily matched and quickly inserted into the chambers of the revolver's cylinder.

Solid Cylindrical Cartridge Loaders

Solid cylindrical cartridge loaders are very well known to the art and have been around for many years in one structure or another. A cartridge loader functions to retain five or six cartridges temporarily in storage in a fixed cylindrical position such as described in U.S. Pat. No. 4,202,124. One of the advantages of a cartridge loader is the simultaneous loading of all rounds into respective chambers saving precious time in a crisis situation. However, the consistent drawback to every cartridge loader is that they are expensive and bulky.

As can be seen there have been a number of patents describing various types of speed loaders for revolver-type firearms, however none has thus far provided a non-complicated, low cost, single-use loading device allowing for the advantages of linear storage available with strip loaders combined with the advantages of accurately and simultaneously releasing cartridges into multiple chambers of the revolver with one hand as available with solid cylindrical cartridge loaders.

An object of the present invention is to combine the advantages of strip type loaders with those of the cartridge type loaders with a lower the cost of production, and improve the loading method through a faster, single-motion loading device and method while providing the advantages of linear storage.

SUMMARY OF THE INVENTION

The present invention is a speed loader mechanism that allows its operator to easily conceal and carry a speed loader for quick and safe reloading of a revolver having individual casings for receiving respective cartridges where the casings are foldably linked to extend in a linear fashion for concealed and comfortable storage and collapsible into a required circular configuration for quick and simultaneous reloading of all cartridges into the cylinder of the respective revolver.

In first embodiment, the present invention includes a multi-chamber firearm speed-loading device having a series of pivotally linked cartridge housings being equal in number to the number of chambers in a revolver cylinder for the multi-chamber firearm, the series of cartridge housings capable of being stored in an extended linear fashion, where each housing is structured and arranged to receive and releasably retain a cartridge within said housing, the series of cartridge housings capable of being rolled into a fixed circular configuration matching the revolver chamber pattern; and each respective cartridge housing having a release button disposed thereon, the release buttons structured and arranged, when in the fixed rolled configuration, for simultaneous insertion and release of the cartridges into the respective revolver chambers.

In some embodiments each cartridge housing includes retaining spring to frictionally engage and releasably retain the cartridge, a release rod having a proximal end connected to each release button and a distal end engaging the retaining spring such that when the release buttons are depressed each retaining spring disengages with each respective cartridge for simultaneous insertion in the respective revolver chamber.

In some embodiments the retaining spring includes a shelf to engage an underside of a rimmed cartridge and the series of cartridge housings in structured and arranged to receive and releasably retain rimmed cartridges.

In some embodiments the series of cartridge housings in structured and arranged to receive and releasably retain rimless cartridges.

In some embodiments a first and last cartridge housing of the series of cartridge housings include a means to secure the device in a rolled into a fixed circular configuration matching the revolver chamber pattern.

In some embodiments each of the first and last cartridge housings include magnets structured and arranged to securely fix the device in rolled fixed circular configuration matching the revolver chamber pattern.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE PREFERRED EMBODIMENTS

The present disclosure will now be described more fully with reference the to the Figures in which an embodiment of the present disclosure is shown. The subject matter of this disclosure may, however, be embodied in many different forms and should not be construed as being limited to the embodiments set forth herein.

Figure 1:
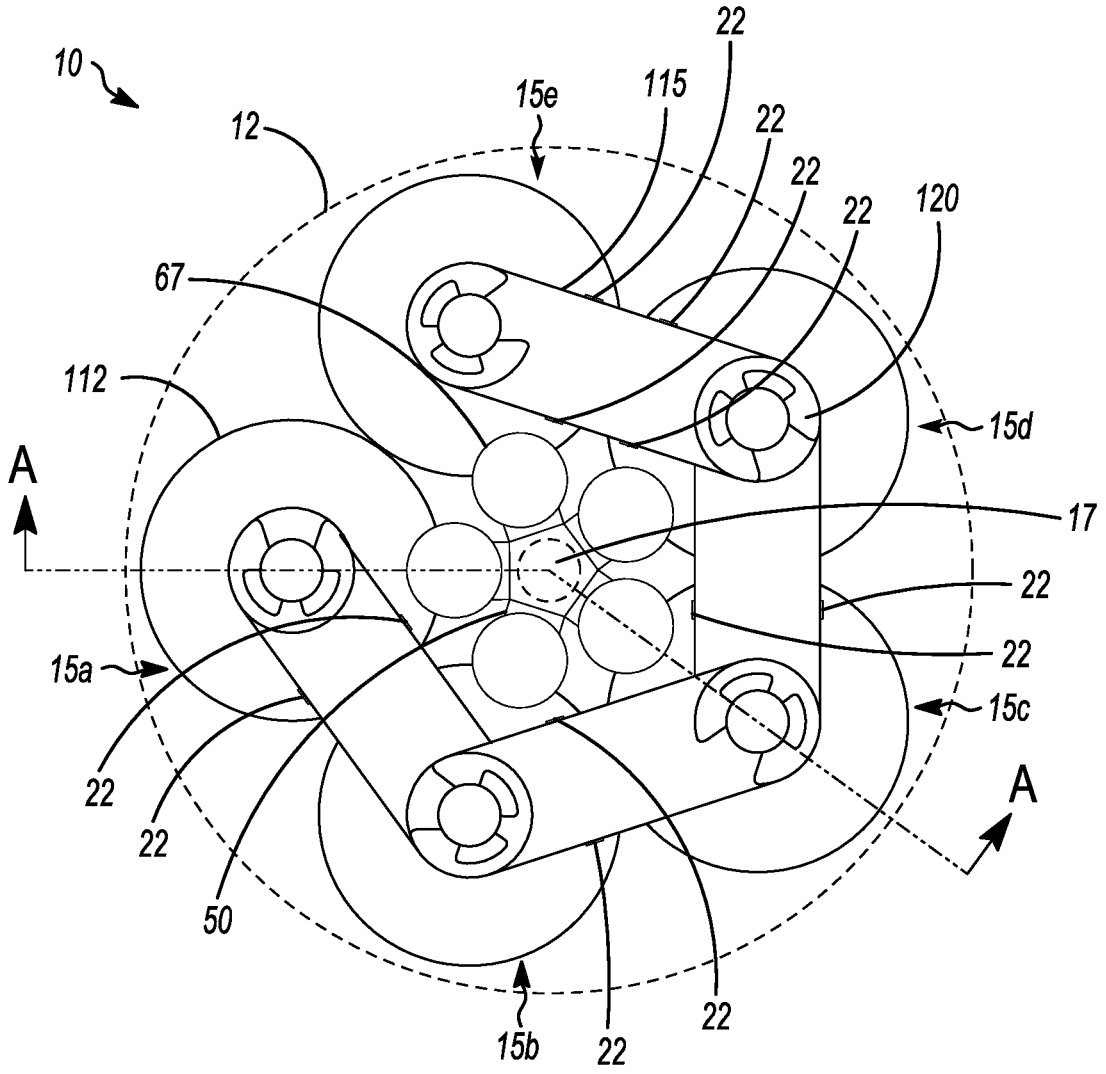
FIG. 1 shows top down view of the speed loader in a collapsed position according to one embodiment of the present invention.
Figure 9:
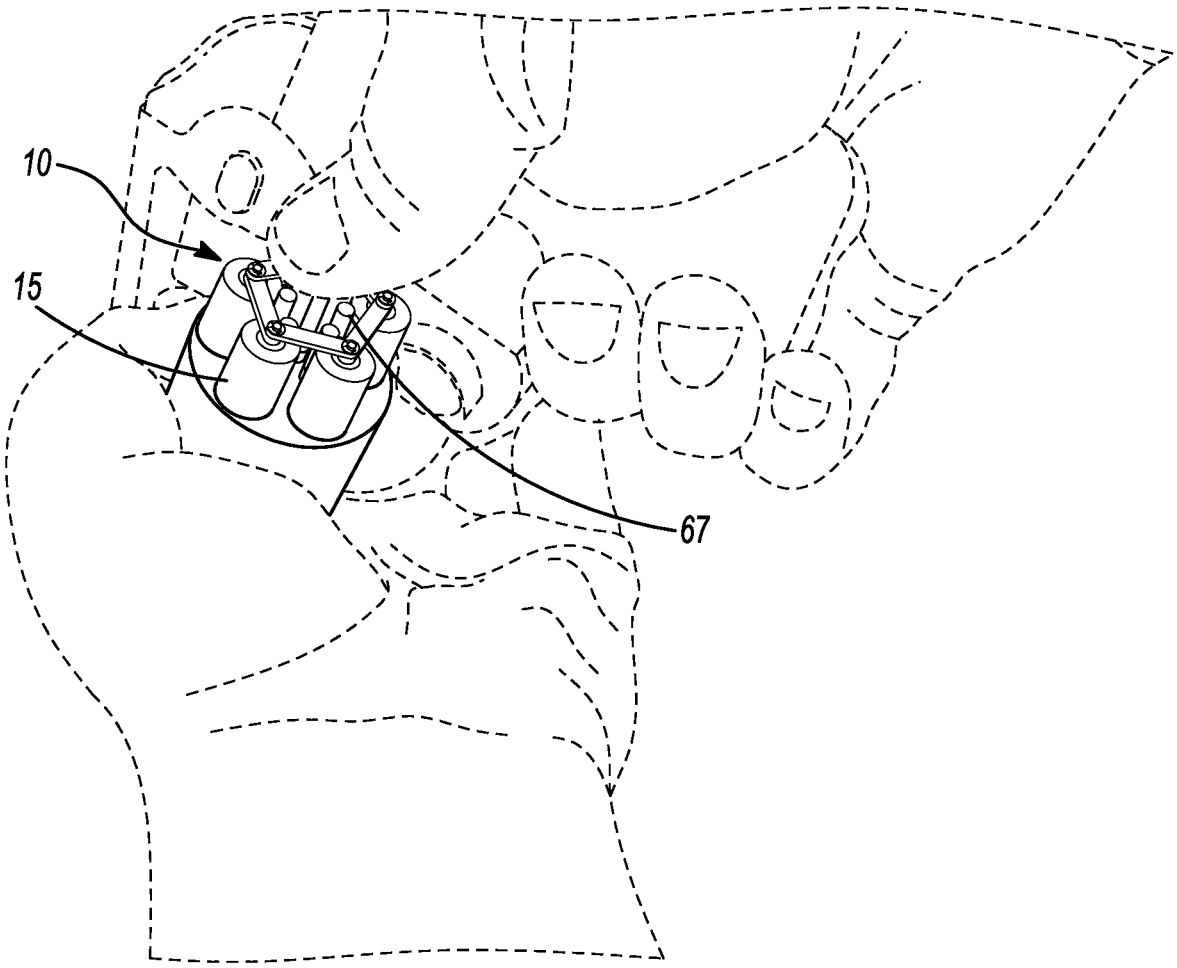
FIG. 9 shows a user manipulating the invention in use with a five cylinder revolver.

Referring now to FIG. 1, there is shown a top down view of invention 10 in a collapsed circular arrangement. Each cartridge housing 15*a* through 15*e* is secured in line together by links 115 secured onto the top of each respective housing via link clip 120. Links 115 are statically affixed to one of cartridge housings 15*d*, 15*c* and 15*b* via tabs 22 in order secure one link 115 to one housing 15 so that a respective pivot limit for invention 10 is achieved. Release buttons 67 are disposed on top of retainer housings 50 and are structured and arranged to be depressed simultaneously as shown in FIG. 9 below. Line A-A is shown as a cut away side view in FIG. 2 and described below.

Figure 2:
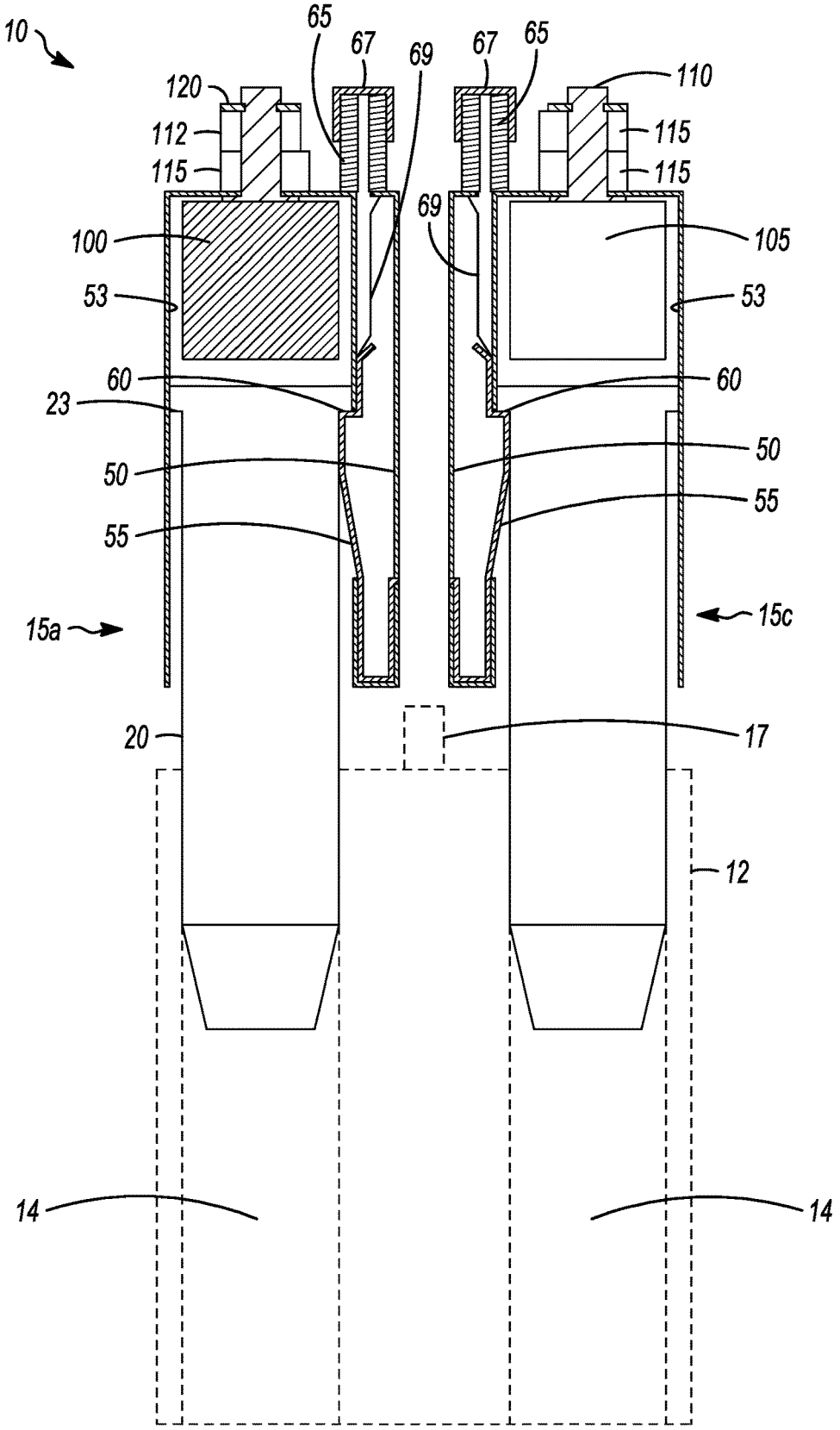
FIG. 2 shows a cut away view along line A-A of FIG. 1 of a speed loader in a circular position and being engaged with a revolver cylinder according to one embodiment of the present invention.

Referring now to FIG. 2 there is shown a cut away view of the speed loader 10 according to one embodiment of the invention along line A-A from FIG. 1. In this embodiment speed loader 10 includes five distinct cartridge housings 15*a* through 15*e* formed and shaped with housing walls 50. Speed loader 10 can also include more or less cartridge housings depending upon the upon number of cylinders in the revolver to be reloaded.

Cartridge housing 15*a* includes magnet 100 disposed interior and above cartridge 20. Magnet 100 is also disposed within cartridge housing 15*e* such that when speed loader 10 is in the collapsed position housings 15*a* and 15*e* are juxta-positioned proximal to one another and releasably secured together by the attractive nature of the magnets. Other means for securing the housings in a collapsed position can be implemented such as clasps, snaps, Velcro® or other similar fastening elements disposed on or in housings 15*a* and 15*e*.

Within retainer housing 50 there is a cartridge retaining lever spring 55 structured and arranged to engage cartridge 20. In some embodiments lever spring 55 includes retaining spring/cartridge interface 60 which engages the underside of the rim 23 on cartridge 20. Lever spring 55 engages the wall of cartridge 20 and is disengaged from cartridge 20 by release rod 69 when a user depresses release button 67 disposed upon the top of each retainer housings 50. Upon depressing release button 67 return spring 65 in place under release button 67 on top of retainer housing 50 is depressed. Release rod 69 is connected to release button 67 and when release button 67 is depressed release rod 69 is displaced downward toward the lever spring 55. As release rod 69 is displaced downward lever spring 55 is displaced laterally away from the exterior of cartridge 20 in order to drop cartridge 22 in a chamber 14 of revolver 12.

The invention is structured and arranged such that when the speed loader 10 is in a collapsed circular position a user may depress all respective release buttons 67 simultaneously in order to reload revolver 12 with all cartridges 20 simultaneously and with only one hand.

Each cartridge housing 15 includes a connecting nipple 110 to which connecting links 15 are connected in order to link housings 15 into a series. The series will contain a number housings equivalent to the number of chambers in a revolver to be reloaded.

Each of the element of invention 10 can be made of materials having suitable rigidness, flex and malleability to achieve the intended goal of the invention. Materials used can include all types of metals, steel, plastics or ceramics. Preferably lever spring 55 is structured and arranged fabricated from a material that provide enough spring tension to retain cartridge 20 within each housing 15. Housing walls 53 are preferably structured and arranged and formed from a material with sufficient rigidity to securely and safely retain cartridges 20 therein until the user desires to reload revolver 14.

Cartridge housing 15*c*, 15*c* and 15*d* include a spacer 102 dispose above the cartridge 20, which spacers can be fabricated from any suitable light weight material but preferably plastics in order to limit the weight of invention 10.

Figure 3:
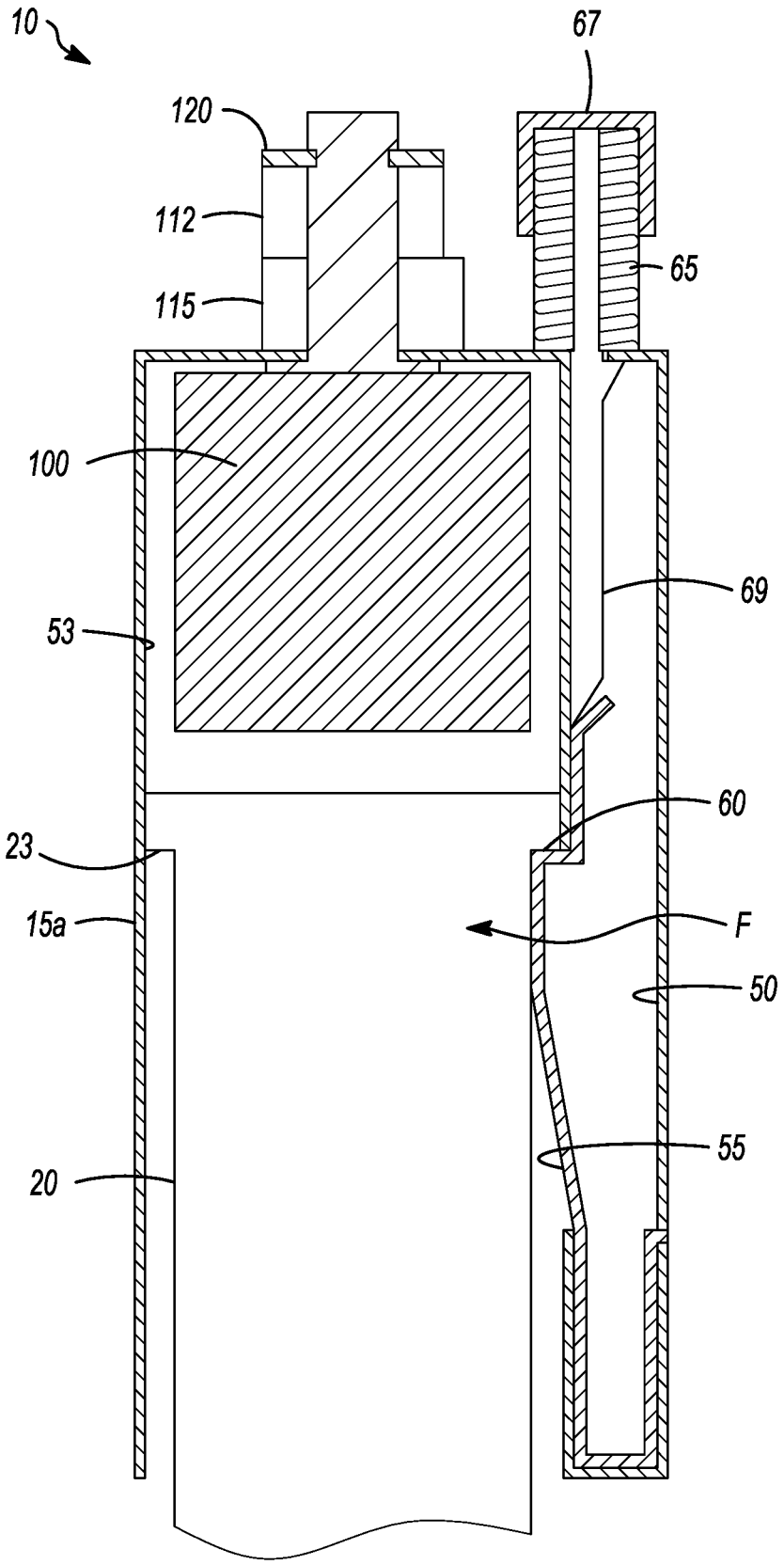
FIG. 3 shows an expanded view of housing 15*a* from FIG. 1 showing the speed loader according to one embodiment of the present invention.

Referring now to FIG. 3 there is shown and expanded cut away view of the cartridge housing 15*a*. Because links 115 need to be stacked on every other cartridge housing 15, cartridge housing 15*a*, and 15*e* (not shown) includes a space 112 between link 115 and clip 120. Force F can be seen as being applied by spring tension from spring 55. Force F as applied to the side of cartridge 20 and allows for retaining spring/cartridge interface 60 to not only engage the underside of the rim 23 on cartridge 20, but also cartridge rim 23 frictionally engages wall 53. This provide additional forces to retain cartridge 20 within housings 15.

Figure 4:
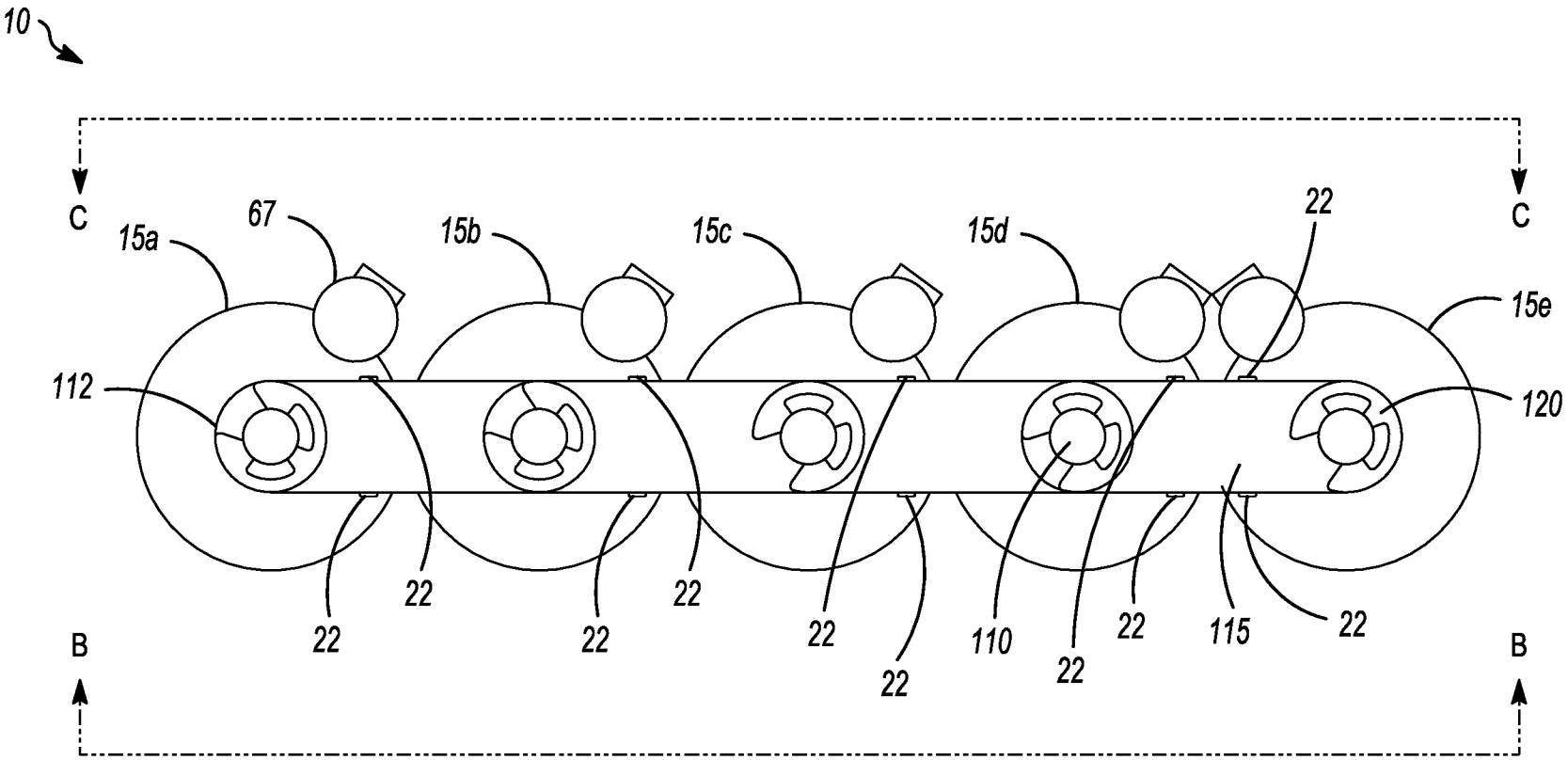
FIG. 4 shows a top down of the speed loader in an extended position according to one embodiment of the present invention.

Referring now to FIG. 4 there is shown a top down view of invention 10 in an extended position. For each of cartridge housings 15*d*, 15*c* and 15*b* links 115 are pivotally mounted respectively thereto, however links 115 are statically affixed to one of cartridge housings 15*d*, 15*c* and 15*b* via tabs 22 in order secure one link 115 to one housing 15 so that a respective pivot limit for invention 10 is achieved. For cartridge housing 15*e* and 15*d* links 115 are statically affixed respectively thereto again to provide a stop to free rotation of each housing relative to the links in order to set a pivot limit for the housings.

Figure 5:
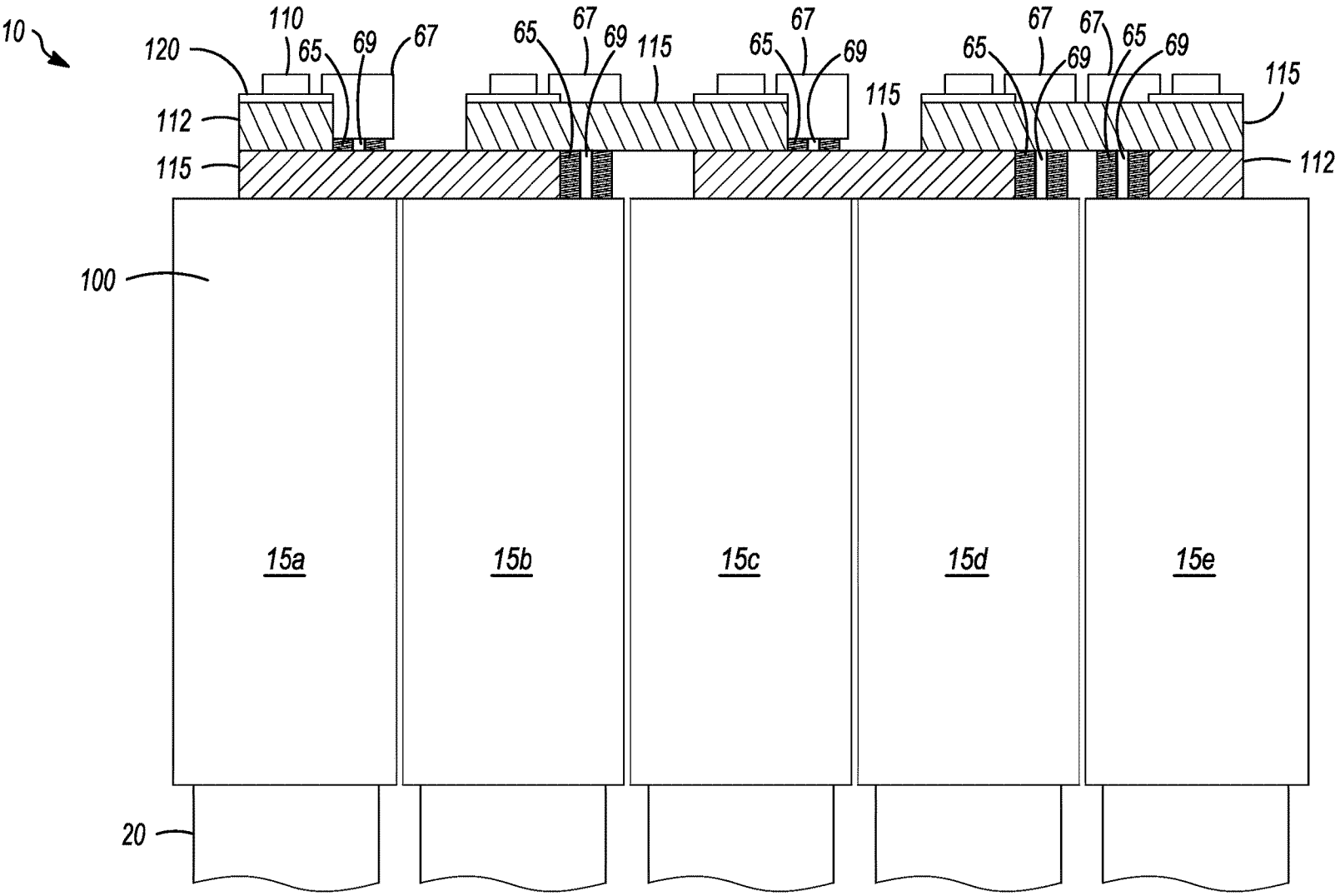
FIG. 5 shows a side view of the speed loader in an extended position according to one embodiment of the present invention.
Figure 6:
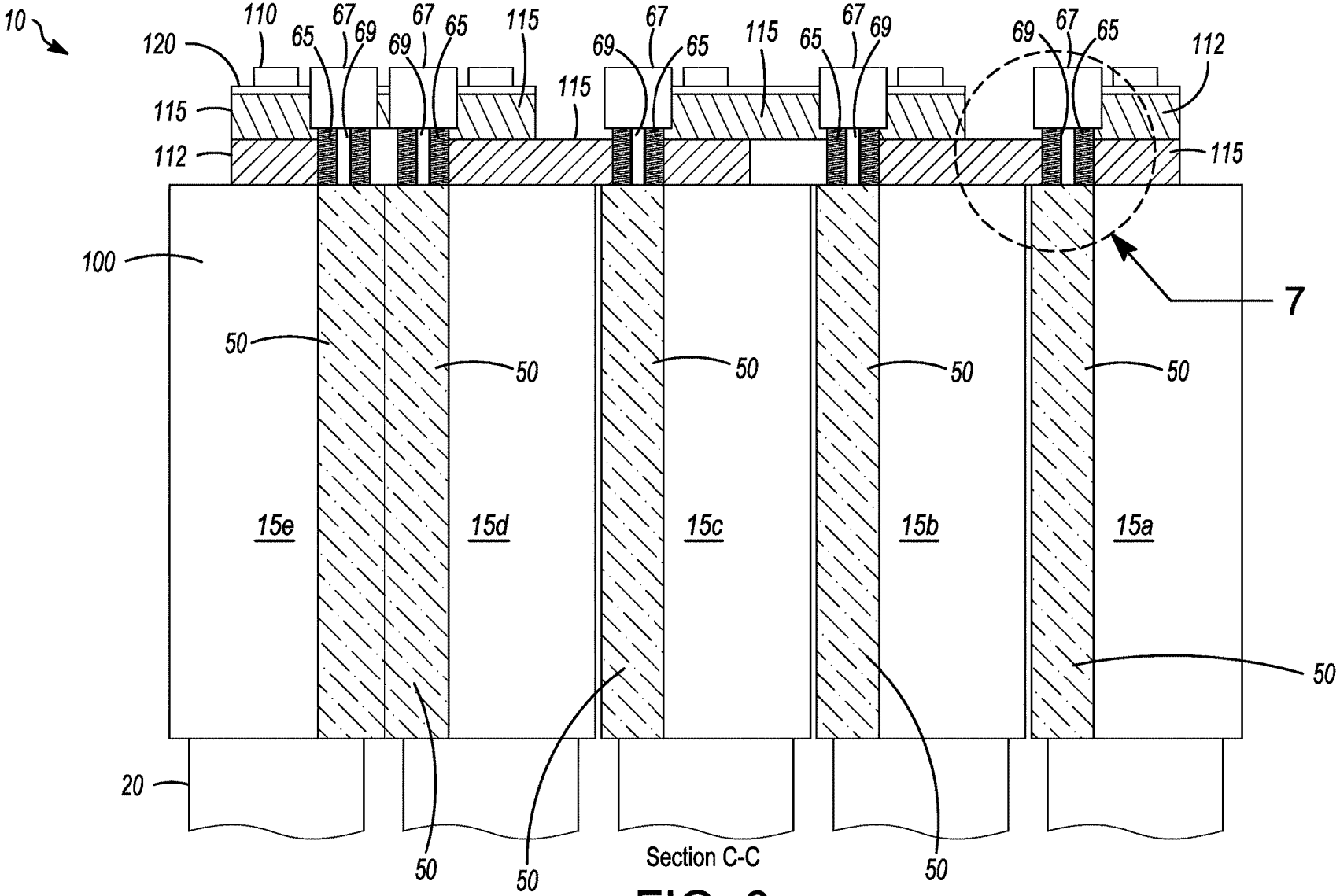
FIG. 6 shows another side view of the speed loader in an extended position according to one embodiment of the present invention.

Referring now to FIG. 5 there is shown a side view of invention 10 in the extended position from the perspective of line B-B of FIG. 4. Spacers 112 can be seen located on top of cartridge housings 5*a* and 15*e* respectively.

Figure 7:
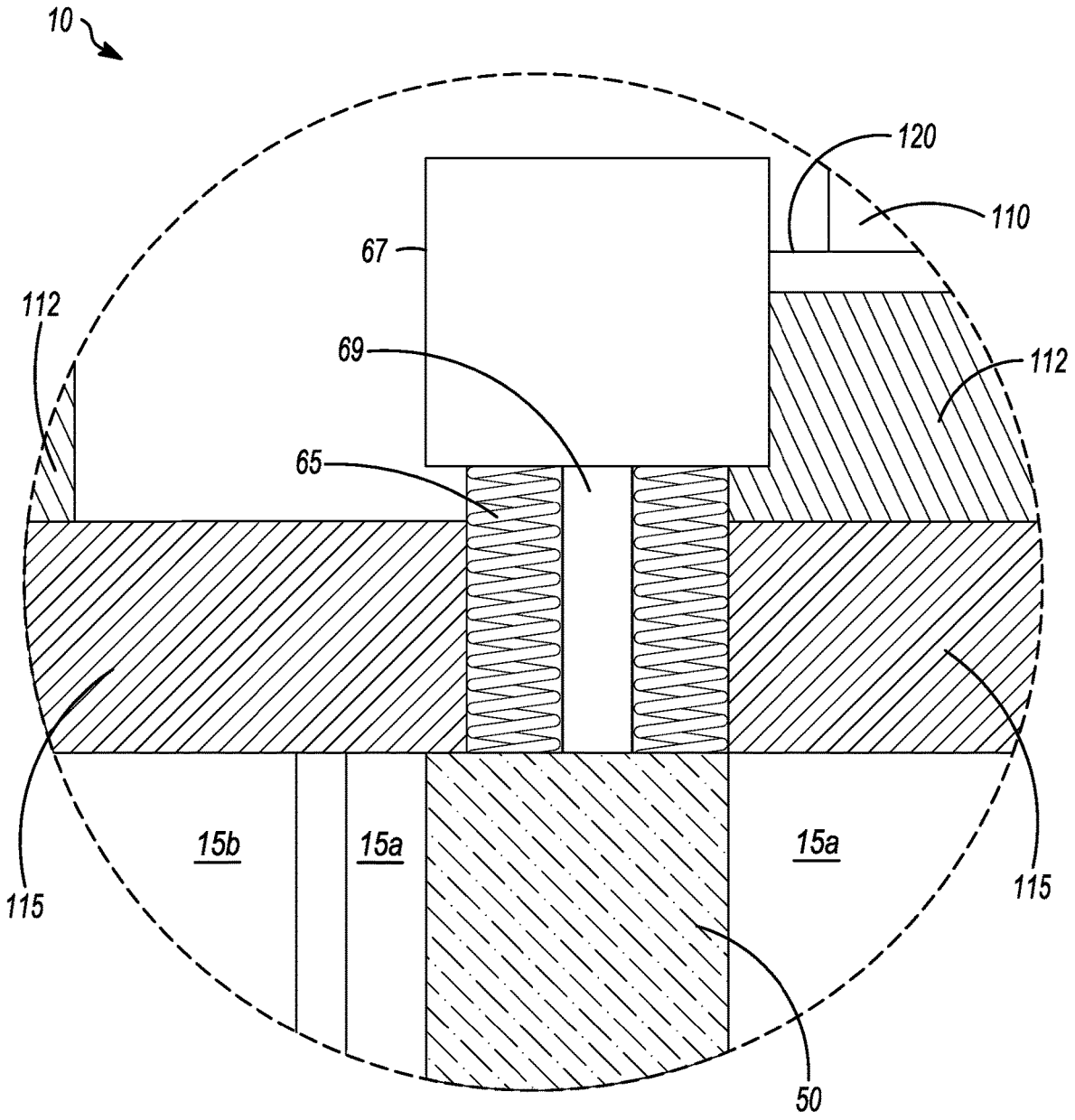
FIG. 7 shows a blown up view of area 7 as labeled on FIG. 6.
Figure 8:
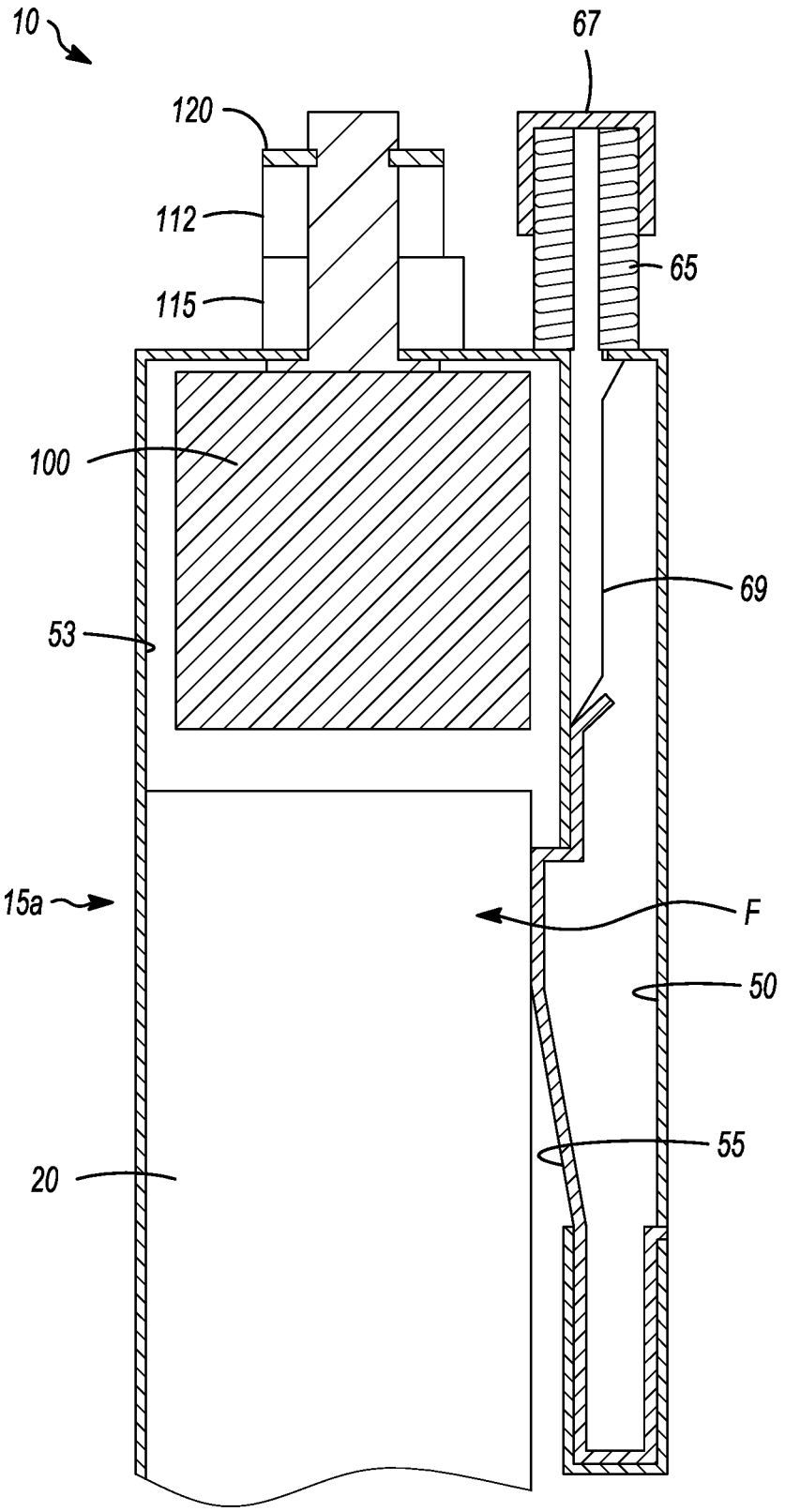
FIG. 8 shows a side cut away view of an alternative embodiment of the present invention for use with a rimless cartridge.

Referring now to FIG. 8 there is shown an alternate side view of invention 10 in the extended position from the perspective of line C-C of FIG. 4. Area 7 is identified for a blown up view as shown in FIG. 7.

Referring now to FIG. 8 there is shown an alternative embodiment of invention 10 where cartridge 20 is rimless. Force F can be again seen as being applied by spring tension from lever spring 55. Force F as applied to the side of cartridge 20 and allows wall 53 to frictionally engages cartridge 20. Combined with the frictional engagement with lever spring 55 there is sufficient force applied to retain cartridge 20 within housings 15 until the user desires to reload a revolver.

FIG. 9 shows the invention being manipulated by a user reloading a revolver by depressing release buttons 67 in order to simultaneously load all cylinders of revolver 12 as the same time.

It will be apparent to one of skill in the art that described herein is a novel speed loader for a revolver. While the invention has been described with reference to specific preferred embodiments, it is not limited to these embodiments. The invention may be modified or varied in many ways and such modifications and variations as would be obvious to one of skill in the art are within the scope and spirit of the invention and are included within the scope of the following claims.

What is claimed is:

1. A multi-chamber firearm speed-loading device comprising:

a series of pivotally linked cartridge housings being equal in number to the number of chambers in a revolver cylinder for a multi-chamber fire arm, the series of cartridge housings capable of being stored in an extended linear fashion, where each housing is structured and arranged to receive and releasably retain a cartridge within said housing, the series of cartridge housings capable of being rolled into a fixed circular configuration matching a chamber pattern for the revolver cylinder;

each cartridge housing including a retaining spring to frictionally engage and releasably retain a cartridge;

each respective cartridge housing having a release button disposed thereon, the release buttons structured and arranged, when in the fixed circular configuration, for simultaneous insertion and release of cartridges into respective chambers of the revolver cylinder; and each respective cartridge housing having a release rod having a proximal end connected to a respective release button and a distal end engaging a respective retaining spring such that when the release buttons are depressed each retaining spring disengages with each respective cartridge for simultaneous insertion in the respective revolver chamber.

2. The device according to claim 1 where each retaining spring includes a shelf to engage an underside of a rimmed cartridge.

3. The device according to claim 1 where the series of cartridge housings is structured and arranged to receive and releasably retain rimmed cartridges.

4. The device according to claim 1 where the series of cartridge housings is structured and arranged to receive and releasably retain rimless cartridges.

5. The device according to claim 1, where a first and last cartridge housing of the series of cartridge housings include a means to secure the device in the fixed circular configuration matching the chamber pattern for the revolver cylinder.

6. The device according to claim 5 where each of the first and last cartridge housings include magnets structured and arranged to securely fix the device in the fixed circular configuration matching the chamber pattern for the revolver cylinder.

* * * * *